US006267652B1

(12) United States Patent
Friel, Sr. et al.

(10) Patent No.: US 6,267,652 B1
(45) **Date of Patent: *Jul. 31, 2001**

(54) VERSATILE ULTRAHONE SHARPENER

(75) Inventors: Daniel D. Friel, Sr., Greenville, DE (US); Daniel D. Friel, Jr., Kennett Square, PA (US); Robert P. Bigliano, Wilmington, DE (US)

(73) Assignee: Edgecraft Corp., Avondale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/641,463

(22) Filed: Aug. 18, 2000

Related U.S. Application Data

(62) Division of application No. 09/226,569, filed on Jan. 7, 1999, now Pat. No. 6,113,476.

(60) Provisional application No. 60/070,760, filed on Jan. 8, 1998.

(51) Int. Cl.[7] ..... B24B 7/00

(52) U.S. Cl. ..... 451/177; 451/259; 451/282; 451/293

(58) Field of Search ..... 451/45, 177, 185, 451/65, 192, 193, 259, 262, 263, 267, 282, 293, 548

(56) References Cited

U.S. PATENT DOCUMENTS 6,113,476 * 9/2000 Friel, Sr. et al. ..... 451/177

* cited by examiner

*Primary Examiner*—Derris H. Banks
(74) *Attorney, Agent, or Firm*—Connolly, Bove, Lodge & Hutz LLP

(57) ABSTRACT

A versatile ultrahoned sharpener includes a stop assembly which contains an inner hardened structure such as being made from metal or ceramic to serve as a positive limiting stop if the knife being sharpened cuts excessively into the plastic stop assembly of the sharpener. The sharpener also includes a manually actuated abrasive surfaced unit for cleaning or shaping the surface of at least one of the sharpening wheels in the sharpener. The sharpener further includes various bearing structures for effectively mounting the motor driven shaft which rotates the abrasive coated disks of the sharpener.

12 Claims, 7 Drawing Sheets

12
21
22
23
13
25
14
14
5
5
6
6
7
7
7
7
8
1
2
3

VERSATILE ULTRAHONE SHARPENER

CROSS-REFERENCE TO RELATED APPLICATION

This application is a division of application Ser. No. 09/226,569, filed Jan. 7, 1999, now U.S. Pat. No. 6,113,476, which is based upon provisional application Ser. No. 60/070,760 filed Jan. 8, 1998.

BACKGROUND OF INVENTION

Previous sharpeners disclosed in U.S. Pat. Nos. 5,611,726, 4,627,194, 4,897,965 and 5,005,319 describe a variety of sharpeners for knives and related tools and products where sharp edges are required.

U.S. Pat. No. 5,611,726 (marketed as a commercial sharpener) describes a two stage high speed sharpener particularly designed for applications where the user wants an extremely sharp edge with a measurable amount of "bite" on the resulting knife edge. This type of edge is particularly desired by commercial users.

SUMMARY OF INVENTION

The new and improved sharpener described here is much more versatile than any of the referenced sharpeners in that it allows the user with only one sharpener to select the type of edge he wishes to create. With this unique design one can create an ultrasharp edge with either substantial "bite", a barely perceptible "bite", or with an ultrasmooth edge with no bite. This is made possible by a unique three stage system that incorporates two stages each with cone shaped disks preferably of metal coated with abrasives which preferably are selected diamond abrasives and a third stage with cone shaped flexible stropping disks—composed of the novel abrasive loaded polymeric materials described in U.S. Pat. No. 5,611,726 or application Ser. No. 09/039,128 filed Mar. 13, 1998 and its provisional application Ser. No. 60/040,766. All of the details of said patent and applications are incorporated herein by reference thereto. In each stage the right and left facets forming the knife edge are sharpened alternately while the sharpening angle is controlled in each stage by two precision knife guides and springs, preferably elastomeric plastic springs as described in U.S. Pat. No. 5,611,726, to insure firm contact of the knife blade with the precision guides. The sharpening angle is increased in each successive stage in order to insure more effective sharpening and to create multi-beveled facets that will stay sharp longer. The magnetic based guides as described in U.S. Pat. Nos. 4,627,194; 4,716,689 and 4,897,965 also may be used to control the angle of the knife blade and hence the sharpening angle. All of the details of these patents are incorporated herein by reference thereto. For optimum results with this new sharpener the grit size of the abrasives used in each stage must be selected carefully. Other novel features disclosed here are precision stop-bars to control the position of the blade on the abrasive disks, motor mounting and shaft supporting means to permit the use of extended shafts to support multiple sharpening disks, and means to reshape and clean the sharpening disks after extended use.

The ability to rapidly create edges with a selected degree of "bite" or to eliminate the bite altogether and create an ultra smooth edge depends on the three stage design and on the use of a stropping disk of the optimum flexibility and with optimal loading of abrasive within a given range of abrasive particle size. While a variety of abrasive materials may be embedded in the stropping disks, alumina (alumina oxide) or Carborundum is preferred. Diamond grits also may be used in these stropping disks.

DETAILED DESCRIPTION

Figure 1:
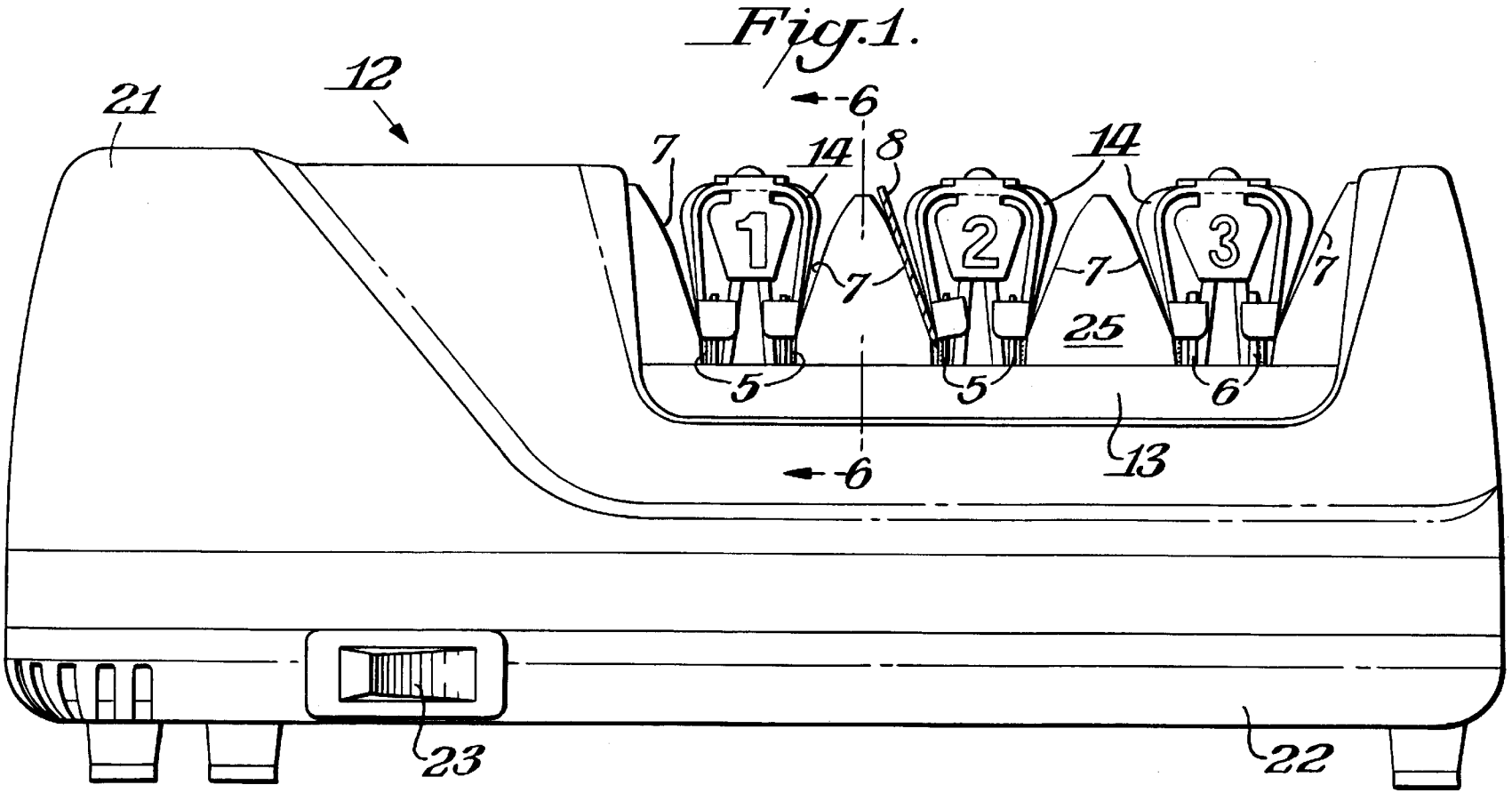
FIG. 1 is a front elevation view of a versatile ultrahone sharpener in accordance with this invention showing three (3) stages, two of which have rigid conical shaped abrasive surfaces for sharpening and the third is a conical flexible honing/polishing stage.

With this new sharpener (12) shown in FIG. 1, the knife (8) shown in Stage 2 is pulled successively along each of the two knife guides (7) in each stage. The knife guides which control the sharpening angle may be different in each stage. The knife is pressed and steadied against each guide by a flexible plastic spring (14) shown in FIG. 1 which covers each stage. The knife edge facet is moved into contact with cone shaped abrasive disks (5) and (6) of FIGS. 2–3 which can be displaced laterally by the pressure of the blade facet which is opposed by the force of a compression spring (15) of FIG. 3 located between the disks (5) and (6). By allowing the abrasive wheel to displace laterally along the motor shaft (16), the sharpening pressure is accurately controlled and the opportunity of gouging the knife edge is minimized.

Figure 6:
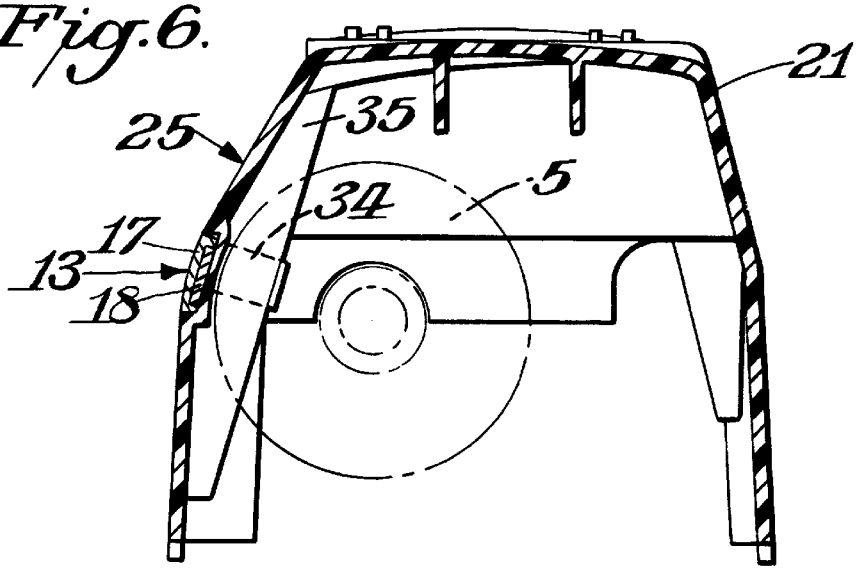
FIG. 6 is an end elevational view in section of a portion of the sharpener shown in FIGS. 1–5.
Figure 7:
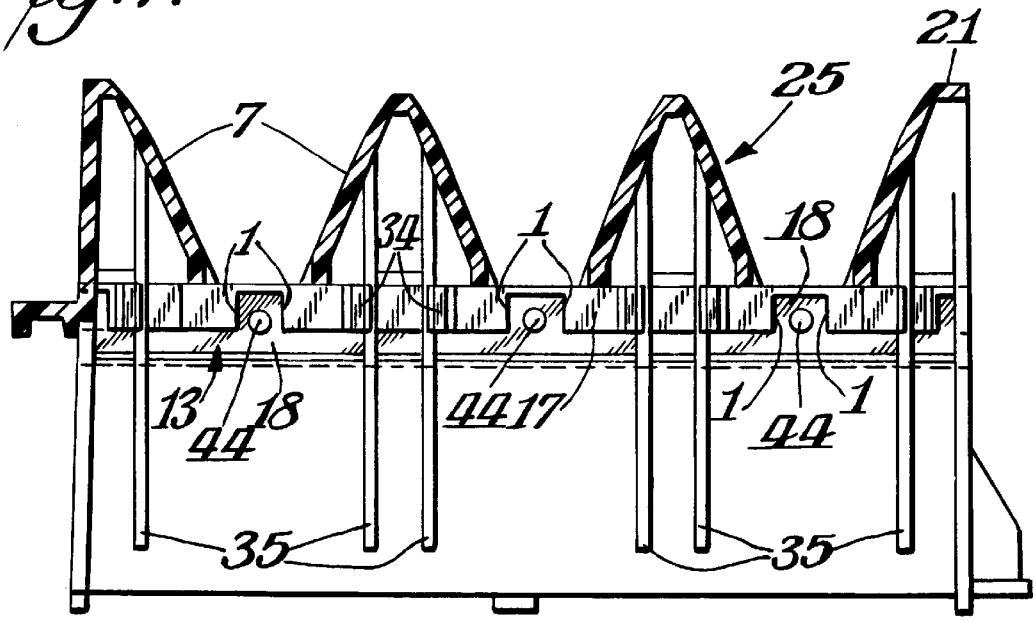
FIG. 7 is a side elevational view of the inner enclosure in the sharpener shown in FIGS. 1–5.
Figure 8:
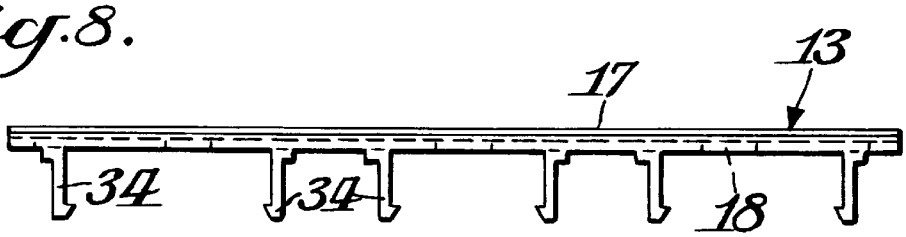
FIG. 8 is a top plan view of the stop member shown in FIGS. 6–7.

A unique knife stop assembly (13) shown in FIGS. 6–8 is provided that limits downward travel of the knife blade as it is sharpened and firmly establishes the position of the knife edge on the cone shaped abrasive wheel. The stop can be made of plastic member (17) that contains an inner hardened metal structure (18) that serves as a positive limiting stop if the knife cuts excessively into the plastic stop assembly. When during the sharpening process and after contact with the abrasive surface the knife edge is brought to rest by the knife stop assembly (13), that portion of the knife edge in contact with the abrasive cone wheel is optimally positioned on the conical surface. The internal metal structure (18) of the knife stop-assembly provides a firm limiting stop against a strike face (1) which is an integral part of the metal stop-bar that prevents further cutting into the stop assembly and prevents the knife blade from cutting ultimately into the drive hubs (19) of FIG. 3 of the abrasive wheels. Thus the sharpening occurs along an effective portion of the abrasive wheel surface.

The metal structure within the plastic stop assembly can be made of any hardened material including ceramics preferably harder than the knife blade itself. Importantly, the angular relationship of the strike face of the hardened material with the edge facet being created in successive stages must be such that the knife edge itself does not come in cutting contact with the hardened material. The angle of the facet that is formed by any one stage is controlled and established by the angle of the knife guide and by the added angle created by the conical abrasive surface. The latter is directly related to the slope of the conical surface and the position of blade contact on the cone surface. The strike face (1) of the hardened metal surface within the knife stop assembly of a given stage can be vertical (90° to the horizontal) so long as the angle of the knife guide in that stage is less than the angle of the facets created in the stage preceding stage in which the knife is being sharpened.

Figure 3:
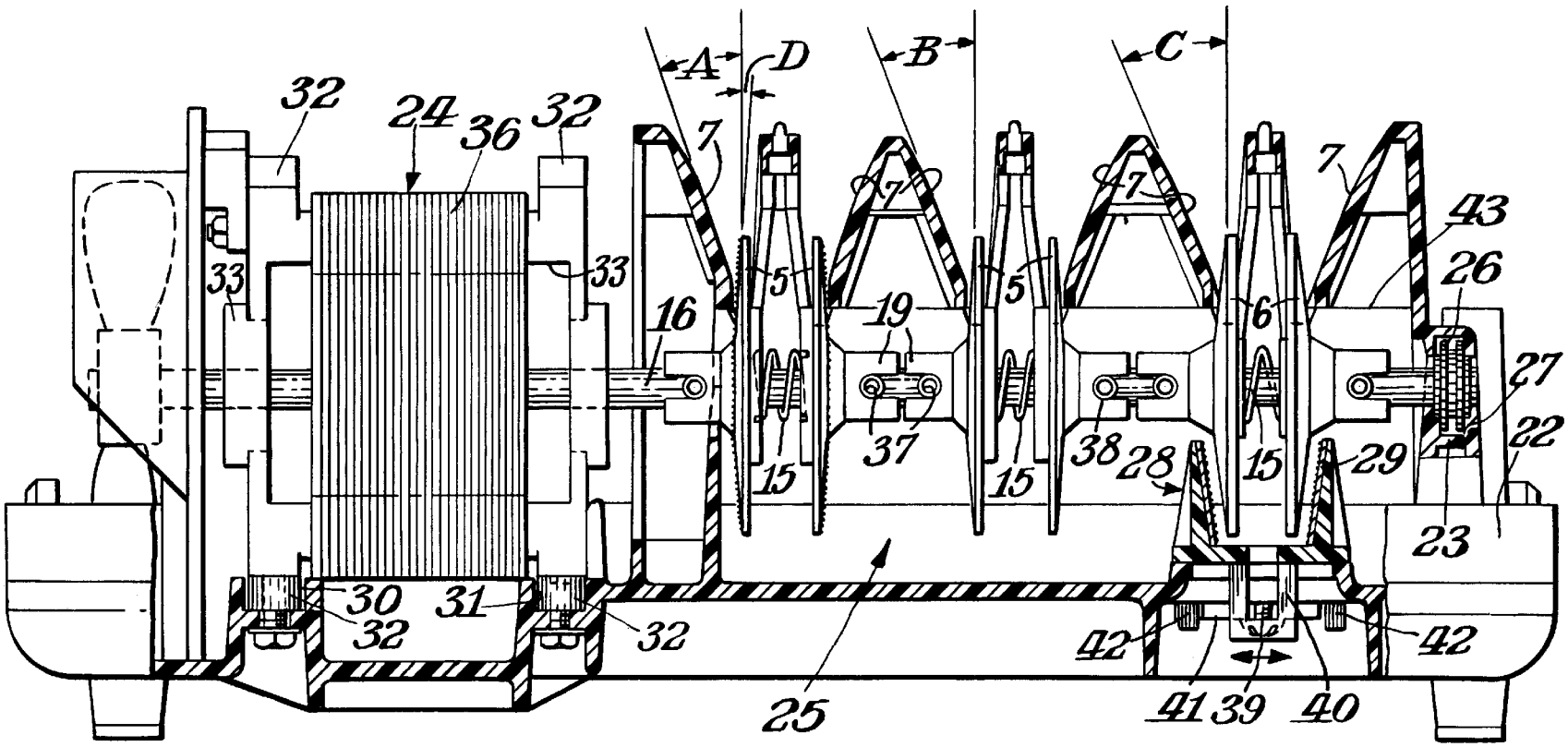
FIG. 3 is a cross-sectional elevational view of the versatile ultrahone sharpener of FIGS. 1–2 with the outer cover removed and the spring guides removed from the inner enclosure thereby showing the supporting structure for the motor drive.

The unique relationship of the angle of the knife guide, the angle of the abrasive surface and the strike face of the hardened stop is further detailed in FIGS. 12–15 and described later in this application. In the sharpener (12) this type of stop assembly (13) is used only forward of the disk. A simple stop-bar (43) shown in FIGS. 3 and 6 is used rearward of the disk. Stop-bar (43) is simply a rugged vertical plastic support bar molded as part of the base. In general this takes far less abuse during sharpening and thus does not need the added protection of the metal stop-bar. The metal bar could of course be used here also.

FIG. 1 shows the sharpener (12) which has a main detachable closure cover (21) which rests on a base (22) that houses a power switch (23) to control motor (24) shown in FIG. 3.

Figure 2:
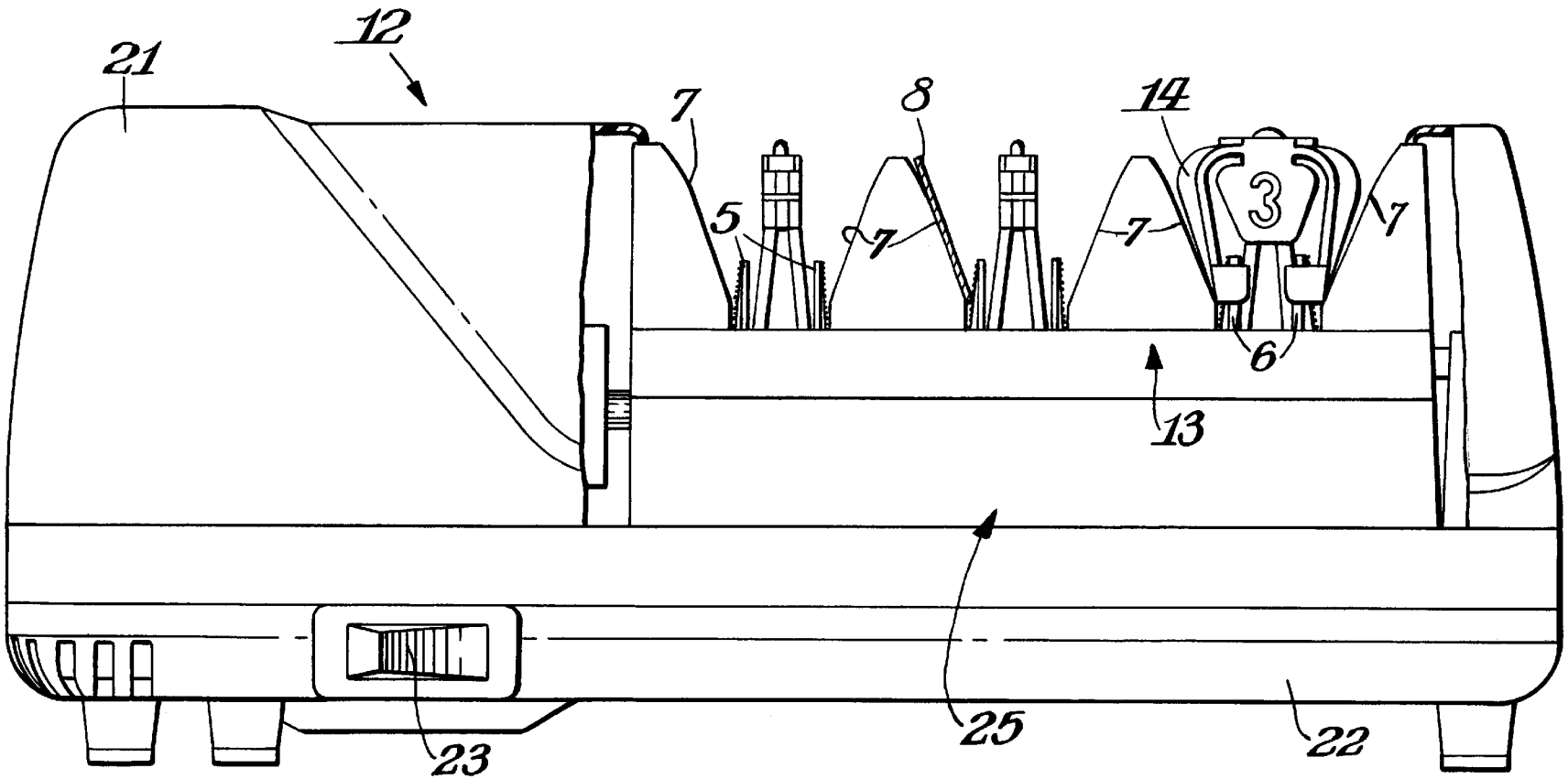
FIG. 2 is a view similar to FIG. 1 showing the spring removed from the first and second stages.

FIG. 2 shows the sharpener (12) with the main closure (21) broken away. An inner detachable enclosure (25) supported by base (22) incorporates knife guides (7) and the stop bar assembly (13), as well as spring covers (14), only one of which is shown. FIG. 1, however, illustrates a spring cover (14) for each of the three stages.

FIG. 3 shows the sharpener (12) with the inner enclosure (25) in place but with the spring covers (14) removed. When the inner enclosure (25) is removed, this then exposes the disks (5) and (6) mounted on hubs (19) that are driven by shaft (16) of motor assembly (24). One end of shaft (16) contains an affixed bearing assembly (26) that rests in a bearing support structure (27). FIG. 3, as well as FIGS. 9–11, shows also a wheel cleaning and shaping unit (28) that contains abrasive pads (29) that can be brought into contact with either of the two disks (6) in the right stage to clean and reshape those disks if and when necessary.

Figure 9:
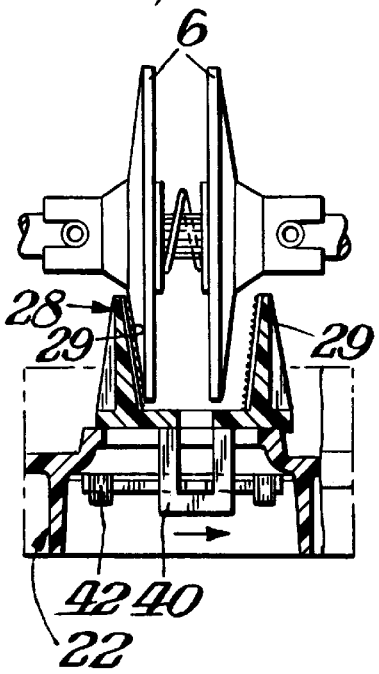
FIG. 9 is a side elevational view partly in section of the third sharpening stage of the sharpener shown in FIGS. 1–4 showing the cleaning and shaping unit.
Figure 10:
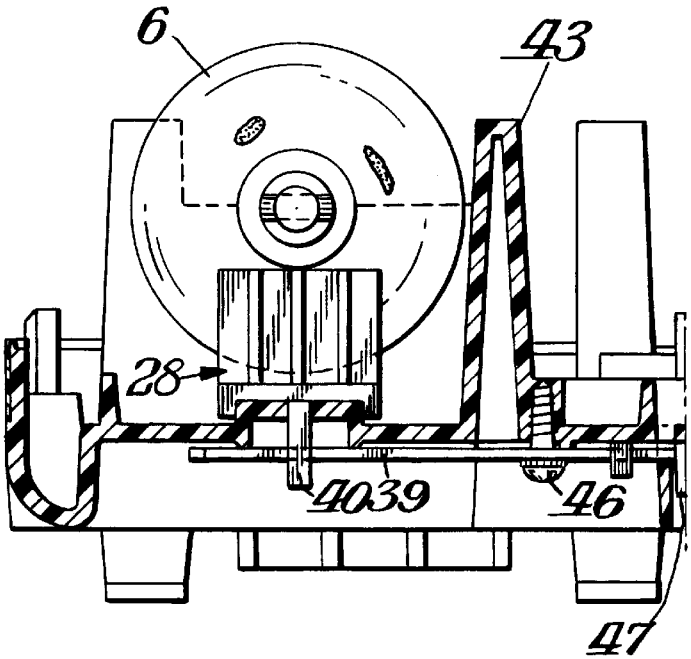
FIG. 10 is an end elevational view of the cleaning and shaping unit shown in FIG. 9.
Figure 11:
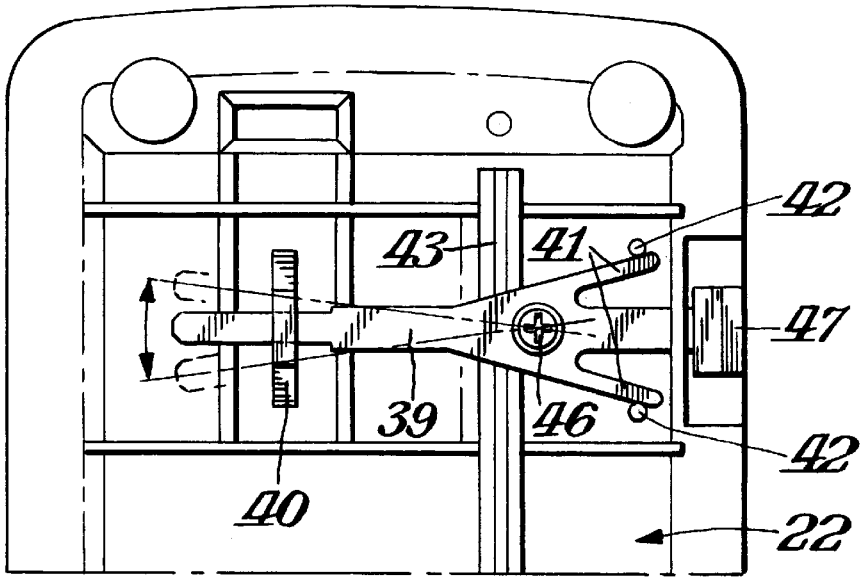
FIG. 11 is a bottom plan view of the cleaning and shaping unit shown in FIGS. 9–10.

A further feature incorporated as part of sharpener (12) is the unique means or unit (28) of FIGS. 9–11 of shaping and cleaning the surface of the soft and flexible abrasive stropping/polishing disks so that their shape and angular configuration can be maintained during their use and lifetime in this type sharpener. This means serves importantly also to remove metal particles that may become embedded in the soft abrasive surface while sharpening or to remove food and foreign substances that may become coated on that surface during the course of sharpening soiled knives.

Figure 4:
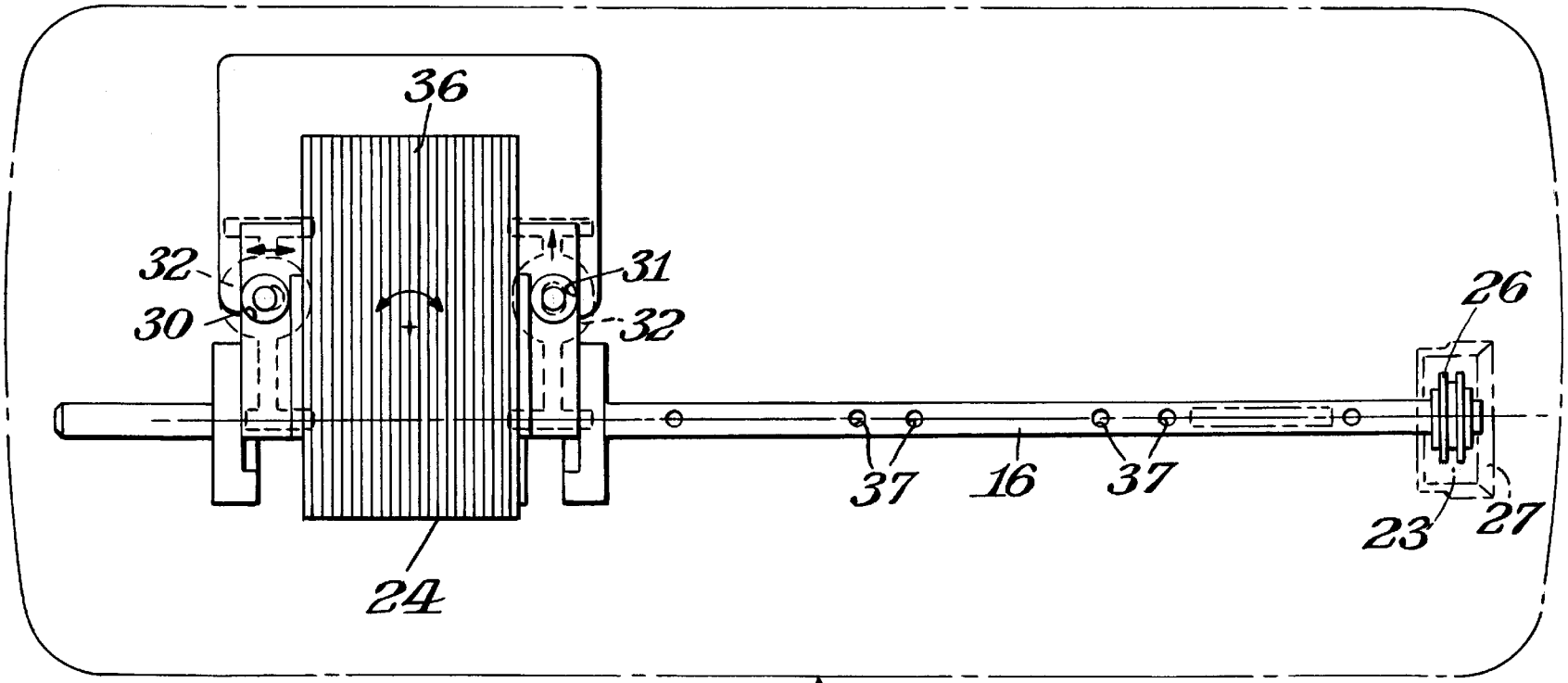
FIG. 4 is a top plan view of a portion of the sharpener shown in FIGS. 1–3 showing the drive shaft and its bearing structures.
Figure 5:
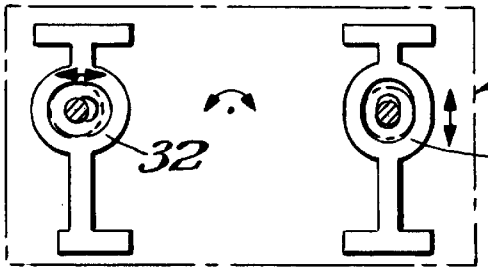
FIG. 5 is a top plan view showing a portion of the sharpener shown in FIG. 4 of one set of bearing structure.

Another unique feature is described herein to support the drive motor and its extended motor shaft where the shaft supports a number of sharpening or honing disks in such a manner as to reduce the resulting friction and stresses on the motor bearings from the forces involved in sharpening. This is accomplished with a bearing assembly (26) shown FIG. 3 mounted on the shaft that rests in a preformed socket (23) in support post (27) in combination with specially designed mounting sockets (30 and 31) on the base (22) into which fits special bosses (32) attached to the motor assembly (24) as also shown in FIGS. 4–5.

Other novel features of this new sharpener are described in further descriptions below.

Reference is made to the earlier U.S. Pat. No. 5,611,726 and the pending applications for background discussions on certain methodology and techniques involved in sharpeners of this type.

Three-Stage Ultrahone Sharpener

The inventors learned that further refinements of a sharpener using two rigid stages with truncated conical abrasive coated disks in combination with one or more stages of flexible stropping/polishing disks of truncated conical shape created a sharpener of unexpected versatility and one capable of producing with high reliability and reproducibility edges of exceptional sharpness and durability.

A preferred embodiment of this sharpener, shown in FIG. 1, is designed to sharpen in three stages identified by bold Numbers 1, 2 and 3 from left to right. The sharpener (12) is enclosed with a detachable main cover (21) that rests on a base (22). On the front is a switch (23) to power a motor (24) of FIG. 3. Inside the main cover is a detachable sharpening module cover (25) of FIG. 2 that structurally supports the six knife guide planes (7), stop bar (13), and the three sets of plastic springs (14), only one set of which is shown. Spring covers (14) have arms that extend along the knife guide plane to steady the blade (8) of FIG. 1 as it moves between these springs and the guide planes while being sharpened. The knife guides in each stage are set at carefully controlled angles relative to the vertical, that angle being larger for each of the two guides (7) in each successive stage. In each of the first two stages there are two truncated rigid conical disks (5) of FIG. 3 coated with abrasives, preferably diamond of carefully selected grits. In the third stage there is a pair of truncated conical flexible disks (6) that contain abrasive particles embedded in a flexible plastic matrix that has optimum elastomeric characteristics as determinable in a modified Rockwell hardness test which is described in the referenced U.S. application and in U.S. Pat. No. 5,611,726.

This three stage sharpener with appropriate grit sizes in Stages 1 and 2 provides unique means of producing ultra sharp edges that can either: (a) retain a "bite" which can be sharpened to be an aggressive or a mild bite depending on the intended use of the blade; or (b) be essentially defect free and smooth with remarkable sharpness. A range of grit sizes can be used but it was found that the optimum sizes for most edges are 120–140 diamond grit in Stage 1 and 240–270 diamond grit in Stage 2. With other than diamonds the optimum grit sizes would be somewhat larger. Grits of this size produced the most durable edges. The flexible disks (6) of Stage 3 must be made of a material with suitable physical properties such as the special epoxy-based or polyolefin-based resins loaded with abrasive particle as described in the referenced U.S. Pat. No 5,611,726 and applications. An abrasive material such as aluminum oxide of particle size ranging from 1 to 20 microns is loaded into the appropriate resin in the range of 40 to 80% by weight. The resulting disks must have the necessary abrasiveness, toughness, and elastomeric properties to quickly remove any burr from the knife edge and simultaneously hone and polish but not damage the ultra fine edge being created.

The sharpener (12) contains a unique stop-bar assembly (13) of FIGS. 2 and 6–8 which snaps onto the front of the sharpening module cover (25) of FIGS. 6 and 7. The stop-bar assembly (13) is shown in place in FIG. 2. The stop-bar assembly (13) of FIGS. 6–8 consists of the plastic stop-bar member (17) and the metal stop-bar (18) with holes that snap over pins (44) of the plastic member (17) as illustrated in FIG. 7. The plastic stop-bar member (17) has six snap-arms (34) of FIG. 8 extending therefrom that are designed to snap around vertical supports (35) of FIGS. 6–7 which are part of the structure on the inner surface of the sharpening module cover (25). The snap arms (34) are designed to retain the stop-bar assembly (13) securely in place on the sharpening module cover (25). The stop-bar assembly (13) is designed to serve as a rest and stop for the edge of blade. This also positions the edge on an optimum portion of the conical surface of sharpening or stropping disks as described in U.S. Pat. No. 5,611,726 and the referenced U.S. applications. The unique metal stop-bar serves to limit damage to the plastic stop-bar member (17) if excessive pressure is used in sharpening and one cuts substantially into the plastic stop-bar (17). The metal stop-bar (18) made of a hardened metal or other hard material provides a positive stop, specially designed as described later herein so as not to damage the sharpened edge.

The motor assembly (24) of FIG. 3 includes metal stack plates (36) onto which is fastened two bearing assemblies (33) that contain integral precision bosses (32) and provide the bearings to support the drive shaft (16) on which are mounted the six truncated cone sharpening and stropping disks (5) and (6). At the end of the shaft (16) is mounted a ball bearing assembly (26) that fits with close tolerance around the shaft and with tight tolerance into socket (23) FIGS. 3–4 which is an integral part of support (27) FIG. 8 which in turn is an integral part of the sharpener's rigid base (22). The motor shaft (16) thus supported on one end by this ball bearing assembly (26) and on the other by a sliding fit into the two precision motor bearing assemblies (33) (which are part of the motor assembly), is captured in the horizontal plane by an in-line 3 bearing, configuration. The shaft end is free to move up vertically within the socket (23) but it is restrained from moving downward by the bottom configuration of socket (23) whose inner shape matches the outer configuration of the shaft and the bearing assembly (26). Thus any downward or lateral thrust on the sharpening disks that would cause the shaft to move down or horizontally is resisted by the close tolerance for clearance of the bearing assembly (26) within the socket (23). A unique motor mounting arrangement was discovered that avoids placing stress in the horizontal plane on the two motor bearings that fit closely around shaft (16). In this arrangement the motor is supported by the precision bosses (32) that fit snugly into precision sockets (30 and 31) of FIGS. 3–5 that are integral parts of the plastic base (22). For reasons of manufacturing convenience each of the bearing assemblies has two of the precision bosses (32) cast thereto in such a way that regardless of which end of the motor a bearing assembly may be bolted, one of the precision bosses thereon will be below the bearing assembly and fit into one of the precision sockets (30 and 31). Precision socket (30) is elongated along in the direction parallel to the axis of the shaft by about 0.050" and precision socket (31) is elongated transverse to the long axis of the shaft by about 0.050". The motor shaft (16) is free to slide linearly within each of the bearing assemblies and the motor assembly therefore can slide linearly along the shaft. Thus if the motor shaft is captured by virtue of the snug fit of the bearing assembly (26) into the base socket (23), the motor assembly can be slid along the axis of its shaft (16) until the rear boss (32) fits into the rear elongated socket (30). The elongation of socket (30) allows the rear bearing assembly and its boss (32) to be slid forward or rearward until the forward boss (32) drops into the forward elongated socket (31). If for any reason the dimensional distance between the rear and front bosses (32) varies slightly from motor to motor, the elongation of socket (30) accommodates the variation. Likewise if for any reason the axial alignment of the two bosses (32) is not perfectly parallel to the motor shaft, the transverse elongation of the forward socket (31) will accommodate that variation. The bosses (32) otherwise fit snugly with a clearance tolerance of only a few thousandths of an inch within the narrow dimension of each socket. Because of this unique design, the motor shaft is not subjected to any lateral stress within its three bearings, and hence it rotates freely with no added friction. It is important that the sharpener base (22) be dimensionally stable and molded or otherwise constructed to tight tolerances so that the shaft and its bearing assembly (26) passes through socket (27) with no downward thrust on the socket because of misalignment or lack of tolerance control. Overall tolerances must be held within a few thousandths of an inch. If necessary the height of socket (30) or (31) can be adjusted so that under no load the drive shaft and its bearing assembly (26) clear the bottom of the base socket (34) with only a few thousandths of an inch clearance. At the same time the close horizontal clearance between the shaft and the socket (34) prevents lateral movement of the shaft greater than a few thousandths of an inch. This unique motor and shaft mounting arrangement permits a longer than normal shaft length on one side of the motor and the attachment of a plurality of sharpening stages.

While a number of different arrangements of sharpening and stropping disks on the motor shaft is possible, the three stage geometry described here proved remarkably fast and efficient sharpening most knives with only one pull through each of the six slots visible in FIGS. 1, 2 and 3. The knife to be sharpened is pulled alternately through the left and right slots in any stage in order to balance and match the facets being formed on each side of the edge. As needed to accomplish the desired result, added pairs of pulls can be made in any stage. The conical disks (5) and (6) of FIG. 3 are each supported by a mounting hub (19) that is free to slide on the shaft (16). Each hub is slotted as described in referenced patents and applications and each hub is positioned laterally against a pin (37) that fits slidingly into the slot (38) by the action of a compression spring (15) mounted on the shaft between each pair of disks. The compression force on each of these springs (15) is carefully selected to optimize the sharpening performance. To sharpen, the blade (8) is inserted between an angled guide (7) FIGS. 1–3 and the flexible spring (14) so that the knife blade moves down the guide until it contacts the conical abrasive covered surface of a disk (5). The spring (14) holds the blade securely against the guide structure (7) as the blade is pulled thru the slot making contact along the blade edge with the abrasive disks. In this configuration the motor drives the disks for example at rotational speeds up to 3600 RPM as powered by 60 Hertz, or at 2500 RPM if powered at 50 Hertz. The shaft is restrained from making any significant axial motion by the bearing assembly (26) whose location on the shaft is secured by close fitting C-clips riding in grooves on each side of that assembly. Each individual disk (5) or (6) is free, however, to slide away from the pin (37) as caused by the lateral pressure of the blade as it is being sharpened against the abrasive disk. The pin which is press fitted into a hole in the shaft transfers the shaft's rotational torque to each disk. The disk is able to move laterally along the shaft as necessary to accommodate the thickness of the blade while its edge is being sharpened, yet the spring (15) assures spring pressure is always maintained between the blade facet and the moving abrasive surface.

As an alternate design not shown, but described in earlier patents of the applicants are magnetic guides used to hold the blade against the physical guides. These are an alternative to the flexible spring (14) design described above.

By careful selection of the surface speed of the abrasive surface of the disk surface where contact is made with the edge facet, by optimizing the grit size in each stage, and by optimizing the sharpening force controlled by springs (15) an extremely unique and versatile sharpener was developed. This sharpener has the ability to create a variety of fine (non-serrated) edges that have controlled amounts of "bite" which can be optimized in degree and type for each cutting task. Disks of approximately 1.9" diameter and a surface shaped as a truncated cone, incorporated in each stage, are similar in size and cross-section to those described in U.S. Pat. No. 5,611,726. The height of the front stop-bar assembly (13) FIGS. 2 and 6–7 and a rear stop-bar (43) of FIG. 3 on which the knife edge rests behind and in front of the abrasive wheel surface is selected so that the knife edge facet is positioned so that it contacts the upper front quadrant of the abrasive disk surface as it is being sharpened. The rotational direction in each stage is such that the abrasive surface moves away from the edge. With the described arrangement the optimum abrasive surface speeds were found to be surprisingly higher than previously believed practical and the spring forces on the facet during sharpening was found to be lower than previously thought to be practical. The combination of surface speeds up to 1800 feet/minute with spring tensions of between 0.3–0.6 lbs. in Stages 1 and 2 proved highly efficient with no evidence of heating of the fine edge being sharpened. Diamond abrasives used in Stage 1 ideally are on the order of 100–200 grit and in Stage 2 on the order of 200–300 grit. For reasons described below, diamonds are the preferred abrasive for these stages but other abrasive materials could be used with less effective results.

Aluminum oxide grits are used in the Stage 3 disks (6) ranging from 1 to 20 microns embedded in the appropriate aforementioned resins. The spring force used with the Stage 3 disks ranges from 0.6 to 1.6 lbs., but optimally is about 1.2 lbs. These disks also are about 1.9" in diameter.

It was discovered and described in U.S. Pat. No. 5,611,726, Column 6, lines 2–6 as follows: "The use of diamonds for the abrasive is especially desirable a it creates well defined microgrooves." It continues Column 9, lines 55 to Column 10 line 3 as follows: "With continued honing, microfacets are first formed on the ridges of the microgrooves and subsequently microfacets will be created along the valleys of the microgrooves. At that point any edge serrations have been largely removed. FIG. 16B is a perspective view along the edge after repeated honing when well formed microfacets have been created along the sides of the edge. The line of intersections of the grooves on the first facet with the microfacet leaves a fluted structure along the facet surfaces. These flutes have sharp boundaries where they intersect the microfacets and these flutes enter into the cutting action if food or material being cut either compresses or distorts a distance of 5 to 20 microns and comes into contact with these boundaries before severing". This novel micro structure adds to the effective sharpness and cutting ability of the "edge" and the apparent "bite" of the blade. This phenomena contributes importantly to the ability of this new three-stage sharpener to prepare edges of varying "bite" that can be tailored for each specific cutting need.

Figure 16:
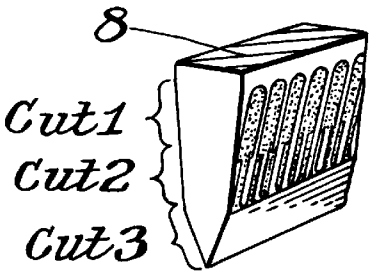
FIG. 16 is a perspective view of a portion of a knife blade showing the affects of being sharpened by the sharpener of FIGS. 1–4.

FIG. 16 illustrates schematically the nature of the edge and facets created by sharpening a blade (8) successively in Stages 1, 2 and 3. In Stage 1 with a sharpening angle of say 19°, larger microgrooves are created across the facet that would extend to the edge. In Stage 2 with a sharpening angle of say 21°, smaller microgrooves are formed across the lower portion of the facet adjacent to the edge, removing the larger microgrooves previously formed on that portion of the facet. In Stage 3, the stropping/polishing material removes the burr left along the edge by Stage 2 and polishes the lowest portion of the facet immediately along the edge. This removes some of the smaller microgrooves and begins to polish the boundaries of those microgrooves forming sharp microflutes where the polishing overlaps the grooves and along the ridges of the microgrooves where polishing occurs. If more polishing occurs the polished area grows and more of the microgrooves are removed.

By sharpening in Stage 1 and then in Stage 3 the same phenomena occurs but the microgrooves and resulting microflutes along the lower portion of the facet are increased in size and effectiveness. This creates an edge structure ideal for fibrous foods such as meat and certain vegetable that benefits from the greater resulting "bite." Clearly the more stropping and polishing that is done in Stage 3 the less "bite" remains and an edge is created ideal for smooth cutting of vegetables such as tomatoes or for very thin slices of certain foods. For cutting of other materials such as wood, some find it optimal to sharpen in Stages 1 and then in Stage 2 before Stage 3 in order to leave smaller microflutes along the lower portion of the facet than if one sharpened only in Stage 1 and then in Stage 3. Clearly this arrangement and choice of grits in Stages 1 and 2 together with the efficient stropping action in Stage 3 provides a very versatile sharpener which gives the user a wide range of choices for edges with varying amounts of "bite", including no discernable "bite" when that is preferable.

Unique Stop-Bar Design

The position of stop bars relative to the sharpening disks is important to insure that the knife edge facet contacts the optimal area of the sharpening and stropping disks. The use of two stop bars one beyond the disk contact area and one in front of that area as described in U.S. Pat. No. 5,611,726 can precisely establish the line along which the knife edge travels. In order to avoid having the knife edge cut seriously into the stop-bar, and thus lose control of where the edge will contact the abrasive disks, a unique means was discovered that limits the extent of cutting into the stop-bar. This means is a hardened metal or ceramic bar (18) of FIGS. 7, 8 and FIGS. 12–15 with vertical or nearly vertical strike faces (1) that will be contacted by the knife edge facet or by the shoulder where the edge facet meets the face of the blade. The vertical or nearly vertical strike faces (1) on the metal bar are designed so that the sharpened edge itself will not strike the face or cut into it. This metal bar can be exposed or for cosmetic purposes it can be enclosed in a plastic member (17) of FIGS. 6–8. In the later case, the metal bar becomes a fully effective stop only when the plastic member has been cut into sufficiently so that the knife edge facet makes contact with it. Generally the stop-bar (18) will have a number of "vertical" strike faces (1), one for each knife guide.

Figure 12:
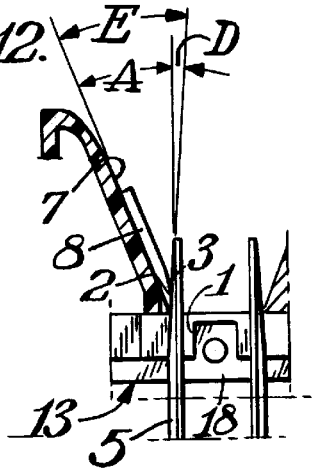
FIGS. 12–15 are side elevational views partly in section showing different phases of operation of the sharpener shown in FIGS. 1–4.

In the sharpener (12) the sharpening angles are progressively larger in each succeeding stage. For example, in Stage 1 the angle A of each knife guide (7) may be 19° as illustrated in FIG. 12. In Stages 2 and 3 the guide angles B and C are for purposes of illustration shown as 21° and 23° respectively. The angle D, FIG. 12, at the surfaces of the conical abrasive disks (5) in Stages 1 and 2 where the knife edge facet contacts those disks is about 2.75° from the vertical. Thus as illustrated in FIG. 12, the angle of the facet formed at the blade edge by the abrasive action in Stage 1 is the total of angles A and D, i.e. angle E which is 21.75°.

Figure 13:
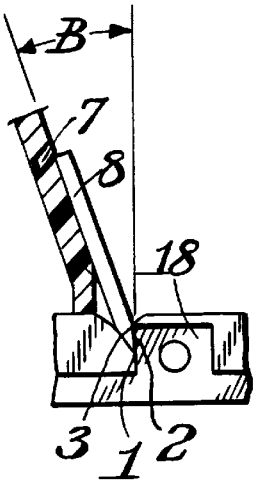
Figure 14:
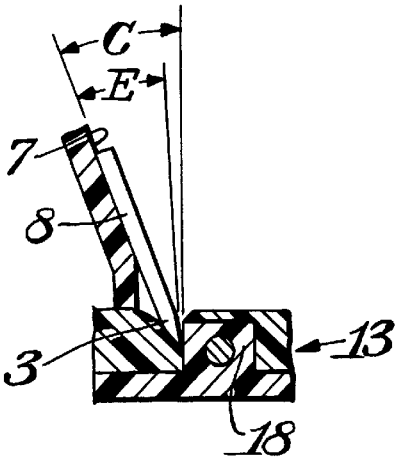
Figure 15:
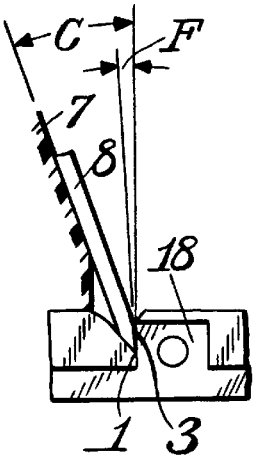

When the blade which has been sharpened in Stage 1 is moved to Stage 2 which has a guide angle B of 21° (slightly less than 21.750°), the shoulder (3) of the facet (2) where the facet meets the blade face, will strike the vertical strike face (1) of stop-bar (18) as shown in FIG. 13. In order to prevent the edge from cutting into a vertical strike face (1) of stop-bar (18) the angle B of the Stage 2 knife guide must be less than the sum of the angle A of the preceding Stage 1 knife guide plus the angle D added by the slope of the conical shaped abrasive surface of Stage 1. The strike face (1) of the stop-bar (18) does not have to be vertical as in FIG. 13 but can set at a lesser angle if the angular relationship so requires. For example if one wishes to by pass Stage 2 and moves the sharpened blade from Stage 1 to Stage 3 (with angles A and C of 19° and 23° respectively), the facet angle E of 21.75° generated in Stage 1 is less than 23° and hence the edge itself would strike the face (1) in Stage 3 if that strike face is set vertical at 90° as shown in FIG. 14. However, if the stop-bar strike face (1) is constructed 88° to the vertical as in FIG. 15 (a two degree change) shoulder (3) of the Stage 1 facet will strike the face, thus protecting the edge. Hence the angle of the strike face (1) of the stop-bar can be adjusted so that the edge is protected at the same time that the strike face serves as a positive stop as it contacts the shoulder of the knife edge facet. Stated mathematically the edge is protected in a subsequent stage if the sum of the knife guide angle and the angle (relative to the vertical) of the abrasive surface at the edge contact point in the preceding Stage is greater than the sum of the knife guide angle and the strike face angle F in the subsequent stages (as in FIG. 15) less 90°. For the example of FIG. 15, 21.75°>23°+88°−90° or 21.75°>21°. This protects the edge itself.

This design of a stop-bar that will stop the blade, without damaging the edge is unique and is practical where precision guide angles are inherent in the sharpener design.

In the sharpener (12) the stop-bar angles F are 90° in Stage 1, 90° in Stage 2, and 88° in Stage 3 when the blade guides are set respectively at 19, 21 and 23°. The angle D added by the conical surfaces of disks (5) of Stages 1 and 2 is 2.750°. The conical angle of the Stage 3 stropping disks (67) is commonly set about 4°. As the knife is moved from Stage 1 and sharpened in Stage 2, the angle of the facets will be increased from 21.75° to 23.75°. As that angle increases there is added protection and the vertical strike face continues to be adequate. If that edge were then moved to Stage 3, with knife guides at 23° a vertical strike face would be adequate, however, an angle F of 88° is necessary if the blade will on occasion be moved from Stage 1 to Stage 3. This change to 88° for Stage 3 in this configuration is preferred because Stage 3 uses a flexible mildly abrasive disk which will modify the entering facet angle only slowly.

If the angle of the strike face of the stop is selected to be just slightly less than the angle of the facet being created, the stop face can act cooperatively with the sharpening process and reduce or straighten any burr remaining along the knife edge on that side of the edge adjacent to the stop. In general, however, the burr being formed in the subject Stage as a blade is pulled along a knife guide will be located along the edge away from the abrasive surface and away from the face of the stop contacted. To the extent that the stop straightens any residual burr on that side of the edge facing the stop it makes the sharpening process more efficient when the adjacent facet is subsequently sharpened.

The hardened metal stop described above can be used alone or imbedded within a plastic "bar" that acts as the knife stop until the plastic is cut sufficiently by usage to expose the metal structure to the knife edge facets. Cosmetically this is a more acceptable arrangement, but the presence of the internal metal stop prevents destruction of the otherwise plastic stop or housing as a result of repetitive cutting by the blade as it is repetitively sharpened.

A surprising discovery during this study was that it is possible to design such hardened stops with uniquely and carefully selected angles (related to the guide angles and the angle of abrasive surfaces) so as to avoid damage to the knife edge as it is being sharpened in single stage or multistage sharpeners such as described here.

Novel Shaping and Cleaning Tool

A further feature of the invention is a unique means or unit for shaping and cleaning the surface of the soft and flexible abrasive stropping wheel so that the shape and angular configuration of the wheel can be maintained effective during its use and lifetime of this type sharpener. This new means or unit (28) of FIGS. 3 and 9–11 also serves importantly to remove any metal particles from the soft abrasive surface that may become embedded in that surface during its use in sharpening.

Soft stropping wheels can lose their shape when the regular and repetitive contact of the blade is greater on certain areas of the abrasive surface. Some portions of the disk surface will therefore wear and erode faster than other portions of the wheel as a result of use. This leads to irregular sharpening or loss of sharpening efficiency.

To maintain the contour of the conical shaped abrasive stropping disks (6) described here, a pair of diamond coated pads (29) of FIGS. 3 and 9 are used. It was surprising to find that diamond abrasives could remove the surface of the elastomeric plastic based abrasive wheels so effectively. The mechanism described below proved very effective and the abrasive diamond surface did not clog as the plastic abrasive wheel was shaped. This proved to be a novel means to obtain and maintain a precise conical contour and to remove the sharpening debris.

The arrangement shown in FIGS. 3 and 9–11 employs a sled-like mechanism (28) that can be moved into contact with the abrasive cone shaped disks (6) along a line radius of their conical surface. The sled (28) can be moved either left or right by a suitable mechanism such as a leveraged control arm (39) that has an externally accessible actuating end (47) in FIGS. 10 and 11. When a pad (29), coated with diamonds, contacts the conical surface of disks (6) along a radius it removes irregularities on the surface and removes any metal particles or foreign material that tend to glaze the conical disks. Only minimal manual pressure need be applied to "true" the conical disk. While other abrasives may be used, preferably the abrasive pad is coated with diamonds.

The abrasive loaded conical disks (6) can be resurfaced by moving the pivoted manually actuated control arm (39) that rides in a yoke (40) under the sled (28) on which the abrasive pads (29) are mounted in an upright fashion as shown in FIGS. 3 and 9. Spring arms (41) that are molded onto the plastic control arm (39) act against pins (42) mounted to base (22) to cause the arm and sled to return to a position centered under the two disks 6 in Stage 3. The lever which terminates in actuating button (47) at the rear of the sharpener base pivots about pin (46) and can be moved left or right to clean either the left or right disk.

The three stage sharpener (12) thus provides a unique means of producing ultra sharp edges that either retain a measure of "bite" or are essentially defect free. By sharpening only in Stages 1 and 3 a measure of "bite" is created and retained. By sharpening successfully in Stages 1, 2 and 3 the edge can become incredibly sharp and essentially burr free and defect free. Diamond abrasives are preferably used in Stages 1 and 2. A variety of grit sizes can be used but the optimum sizes for the most durable edges are about 120–140 diamonds grit in Stage 1 and 240–270 grit diamonds in Stage 2. Stage 3, the stropping stage has a conical shaped surface made of alumina grit embedded in a polyolefin based extrudable resin as described in referenced patents and pending applications. The total guide angles in these stages can vary, but optimally are about 38°, 42°, and 46°, respectively. The conical surfaced abrasive wheels can have a variety of cone angles but optimally are between 1° and 4°.

What is claimed is:

1. A sharpener for blades with an elongated cutting edge with facets adjacent to each side of the cutting edge, comprising at least one rigid disk having an exposed abrasive coated surface and at least one flexible disk having an abrasive surface, each of said disks mounted on a shaft for rotation about a horizontal axis to move said surfaces across and away from the cutting edge when the blade is moved into contact with said surface, a blade guide surface juxtaposed each of said disks, said blade guide surfaces being at a predetermined vertical angle relative to a vertical line normal to said axis of rotation of said disks, said blade guide surfaces being in a plane which intersects said abrasive coated surface to function as an angular guide for the blade when the blade is placed against said blade guide surface to dispose the blade in contact with said abrasive coated surface, an edge stop-bar disposed forward of said abrasive surfaces and a second edge stop-bar disposed rearward of said abrasive surfaces, said edge stop-bars providing a location of contact with the blade edge as the blade moves into contact with each of said abrasive surfaces and cooperates with said angular guides to dispose the blade edge facet against said abrasive surface as the blade is moved across said rotating abrasive surface.

2. The sharpener of claim 1 wherein there are two side by side of said rigid disks with abrasive coated surfaces and two side by side of said flexible disks with abrasive surfaces driven rotationally by a motor drive assembly.

3. The sharpener of claim 2 wherein there are a first and a second pair of side by side of said rigid disks with abrasive coated surfaces and one pair of side by side of said flexible disks with abrasive coated surfaces.

4. The sharpener of claim 3 wherein the shape of said surface of said rigid and flexible disks is a truncated cone.

5. The sharpener of claim 4 where the first of said pair of rigid disks are coated with diamonds of grit size approximately 100 to 200, the second of said pair of rigid disks are coated with diamonds of grit size approximately 200–300, and said pair of said flexible disks contain abrasive particles in the range of 1 to 20 microns embedded 40 to 80% by weight in a flexible plastic material.

6. The sharpener of claim 5 where said flexible disks have a recovery in the range of 31 to 75% and a remaining depression of 140–155 divisions as measured on a Wilson Rockwell Tester using a ⅞" diameter steel ball to create the depression with a minor weight of 10 kilograms and a major weight of 60 kilograms.

7. The sharpener of claim 5 wherein the surface speed of said disks at their circumference driven rotationally on said shaft by the said motor drive is on the order of 900–1800 feet per minute, said first and said second pair of said disks on said shaft are separated from each other by a spring arrangement which urges said disks away from each other, said spring arrangement applying a force in the range of 0.3 to 0.6 lbs. for displacements up to 0.15 inches of said disks on said shaft, said pair of flexible disks being separated from each other by a spring arrangement which urges said disks away from each other, and said spring arrangement applying a force in the range of 0.6 to 1.6 lbs. for displacement of 0.15 inches of said disks on said shaft.

8. The sharpener of claim 5 wherein said blade guide surfaces for the first said pair of rigid abrasive coated disks are about 19° to the vertical, said blade guide surfaces for the second said pair of rigid abrasive coated disks are about 21° to the vertical, and said blade guide surfaces for said pair of said flexible abrasive surfaced disks are about 23° to the vertical.

9. The sharpener of claim 3 wherein an inverted U-shaped spring member is centrally mounted over at least one of said first and second pair of side-by-side disks, said spring member having an intermediate connecting portion with attached resilient arms extending downwardly generally along said guide planes and along a portion of said disks, and said spring member serving to stabilize the blade as it moves along said guide planes.

10. The sharpener of claim 3 wherein a magnetic member is incorporated as part of said blade guide surface to stabilize the blade as it moves along said guide planes.

11. A knife sharpener with a motor drive means supported on the base of said sharpener, said drive means consisting of a motor with an integral drive shaft extending from the front end of said motor slidingly supported within two close-fitting bearings mounted one on each end of said motor, a bearing attached and rigidly positioned at a point along said drive shaft, said bearing supported and restrained from horizontal motion transverse to the axis of the shaft by a close fitting socket supported from the base, and two mounting bosses one under each end of motor integral to the motor that mate into and are fastened into two close fitting elongated sockets supported by the base to drive one or more sharpening wheels mounted along the length of said shaft.

12. The knife sharpener of claim 11 wherein the two said mounting bosses integral to the motor are cylindrical with a diameter only a few thousands of an inch less than the width of the close fitting elongated sockets supported by the base, one socket being elongated in a direction nominally parallel to the axis of the shaft, and the other socket elongated nominally transverse to the axis of the shaft.

* * * * *